US007439912B2

(12) United States Patent
Shih

(10) Patent No.: US 7,439,912 B2
(45) Date of Patent: Oct. 21, 2008

(54) ULTRA-WIDEBAND ANTENNA

(75) Inventor: Yen-Yi Shih, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/565,660

(22) Filed: Dec. 1, 2006

(65) Prior Publication Data

US 2007/0279290 A1 Dec. 6, 2007

(30) Foreign Application Priority Data

Jun. 2, 2006 (TW) ..... 95119630

(51) Int. Cl.
*H01Q 1/38* (2006.01)

(52) U.S. Cl. ..... 343/700 MS

(58) Field of Classification Search ..... 343/700 MS, 343/702, 795, 846
See application file for complete search history.

(56) References Cited

U.S. PATENT DOCUMENTS

| | | | | |
|---|---|---|---|---|
| 6,864,842 | B2 * | 3/2005 | Hung et al. | 343/700 MS |
| 6,906,678 | B2 * | 6/2005 | Chen | 343/795 |
| 2005/0156787 | A1 * | 7/2005 | Myoung et al. | 343/700 MS |
| 2006/0145929 | A1 | 7/2006 | Teng et al. | |
| 2007/0120741 | A1 * | 5/2007 | Tseng | 343/700 MS |

* cited by examiner

*Primary Examiner*—Hoang V Nguyen
(74) *Attorney, Agent, or Firm*—Wei Te Chung

(57) ABSTRACT

An ultra-wideband (UWB) antenna (10), disposed on a substrate (30), includes a body (100), a feeding part (160), and at least one first ground plane (120). The body, for receiving and transmitting electromagnetic signals, includes a first radiating part (102) and a second radiating part (104) connected to the first radiating part. The body defines a gap (106) between the first radiating part and the second radiating part. The feeding line, electrically connected to the body, feeds electromagnetic signals to the body. The at least one first ground plane is disposed on a side of the feeding part, and is grounded.

17 Claims, 13 Drawing Sheets

ULTRA-WIDEBAND ANTENNA

BACKGROUND OF THE INVENTION

1. Field of the Invention

The invention relates to antennas, and particularly to an ultra-wideband (UWB) antenna.

2. Description of Related Art

With the development of short-haul wireless communications and the trend of multi-products for personal mobile communications, transmission traffic of wireless communications is increased, and transmitting rates thereof are accelerated. In view of the above, the federal communications commission (FCC) approves the ultra-wideband (UWB) technology for commercial use in February of 2002, and defines the UWB communication system as a high transmission rate, low power, and short-haul communication system. In addition, the institute of electrical and electronics engineers (IEEE) draws the IEEE 802.15 standard for wireless personal area network (WPAN), which has characteristics of high transmission rate and low power. Presently, under the IEEE 802.15 standard, UWB communication devices are restricted to intentional operation between 3.1 and 10.6 GHz.

In recent years, more attention has been paid on developments of small-sized wireless communication devices, such as mobile phones, wireless cards, and access points, for convenient portability. An antenna, as one of the key elements of the wireless communication devices, has to be miniaturized accordingly. Amended bucolical antennas are often used as UWB antennas, but the size of the conventional UWB antennas is large. Therefore, what is needed is a UWB antenna with a small size.

SUMMARY OF THE INVENTION

An exemplary embodiment of the present invention provides an ultra-wideband (UWB) antenna. The UWB antenna, disposed on a substrate, includes a body, a feeding part, and at least one first ground plane. The body, for receiving and transmitting electromagnetic signals, includes a first radiating part and a second radiating part connected to the first radiating part. The body defines a gap between the first radiating part and the second radiating part. The feeding line, electrically connected to the body, feeds electromagnetic signals to the body. The at least one first ground plane is disposed on a side of the feeding part, and is grounded.

Another exemplary embodiment of the present invention provides an ultra-wideband (UWB) antenna. The UWB antenna is disposed on a substrate, and the substrate has a first surface and a second surface opposite to the first surface. The UWB antenna includes a body, a feeding part, at least one first ground plane, and a second ground plane. The body, for receiving and transmitting electromagnetic signals, defines a gap. The feeding part, electrically connected to the body, feeds electromagnetic signals to the body. The at least one first ground plane is laid on the first surface of the substrate. The second ground plane is laid on the second surface of the substrate, and has a length greater than that of the at least one first ground plane laid on the first surface.

Other advantages and novel features will become more apparent from the following detailed description when taken in conjunction with the accompanying drawings, in which:

DETAILED DESCRIPTION OF THE INVENTION

Figure 1:
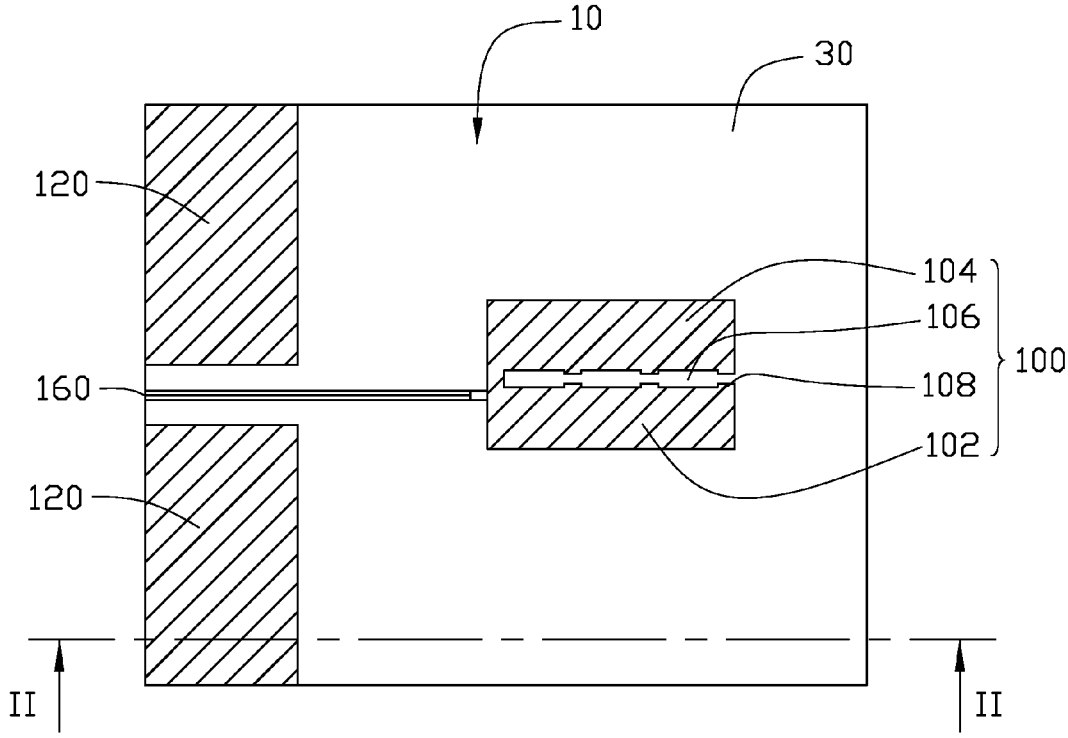
FIG. 1 is a schematic diagram of an ultra-wideband (UWB) antenna of an exemplary embodiment of the present invention.

FIG. 1 is a schematic diagram of an ultra-wideband (UWB) antenna 10 of an exemplary embodiment of the present invention. In the exemplary embodiment, the UWB antenna 10, disposed on a substrate 30, includes a body 100, a feeding part 160, and at least one first ground plane 120. The substrate 30 includes a first surface and a second surface opposite to the first surface.

The feeding part 160 is disposed on the first surface of the substrate 30, and electronically connected to the body 100, for feeding electromagnetic signals to the body 100. The at least one first ground plane 120 is laid on the first surface of substrate 30, and disposed on a side of the feeding part 160. In the exemplary embodiment, the at least one first ground plane 120 includes two first ground planes, respectively disposed on both sides of the feeding part 160. That is, the feeding part 160 is disposed between the first ground planes 120.

The body 100, disposed on the first surface of the substrate 30, receives and transmits electromagnetic signals. In the exemplary embodiment, the body 100 is shaped as a rectangle.

In other embodiments, the body 100 may be shaped as a circle, a polygon or other shapes.

The body 100 includes a first radiating part 102, a second radiating part 104, and a plurality of protruding parts 108. The first radiating part 102 is electronically connected to the second radiating part 104. In the exemplary embodiment, a length of the first radiating part 102 is equal to that of the second radiating part 104. The feeding part 160 is connected to the first radiating part 102.

In other embodiments, the length of the first radiating part 102 may be not equal to that of the second radiating part 104. The feeding part 160 may be connected to the second radiating part 104.

The body 100 defines a gap 106 between the first radiating part 102 and the second radiating part 104. In the exemplary embodiment, the first radiating part 102 and the second radiating part 104 generate coupling effects via the gap 106, so a size of the UWB antenna 10 is reduced. An extending direction of the gap 106 is parallel to that of the feeding part 160.

The protruding parts 108 are protruded into the gap 106. In the exemplary embodiment, some protruding parts 108 are disposed on the first radiating part 102, and the other protruding parts 108 are disposed on the second radiating part 104. The protruding parts 108, disposed on the first radiating part 102, extend from the first radiating part 102 into the gap 106. The other protruding parts 108, disposed on the second radiating part 104, extend from the second radiating part 102 into the gap 106. The protruding parts 108 disposed on the first radiating part 102 are symmetrical to the protruding parts 108 disposed on the second radiating part 104 along a center line of the gap 106. In this embodiment, due to the protruding parts 108 the size of the UWB antenna 10 is further reduced.

In other embodiments, the protruding parts 108 disposed on the first radiating part 102 may be not symmetrical to the protruding parts 108 disposed on the second radiating part 104 along the center line of the gap 106. The protruding parts 108 may only be disposed on the first radiating part 102 or the second radiating part 104, and accordingly extend from the first radiating part 102 or the second radiating part 104 into the gap 106.

Figure 2:
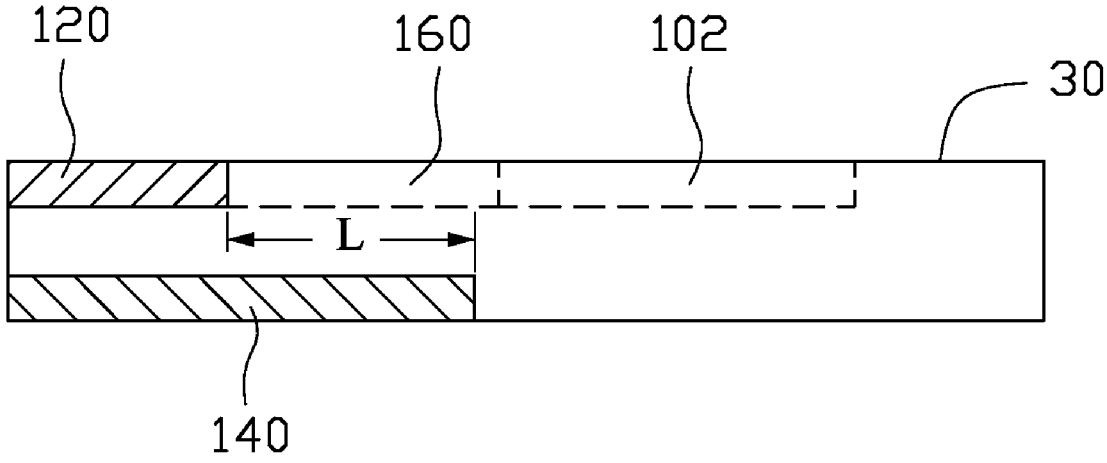
FIG. 2 is a cross-sectional view of the UWB antenna along a line II-II of FIG. 1.

FIG. 2 is a cross-sectional view of the UWB antenna 10 along a line II-II of FIG. 1. In the exemplary embodiment, the UWB antenna 10 further includes a second ground plane 140 laid on the second surface of the substrate 30. A length of the second ground plane 140 laid on the second surface of the substrate 30 is greater than that of the at least one first ground plane 120 laid on the first surface of the substrate 30, and a difference in length there between is L, which increases a mapping effect caused by the second ground plane 140 on the first radiating part 102 and the second radiating part 104. Thus, the working frequency bandwidth of the UWB antenna 10 is further increased.

In the exemplary embodiment, a length of the feeding part 160 is substantially 20 mm, and a width thereof is substantially 0.53 mm. The length of the first radiating part 102 is substantially 13.9 mm, a width thereof is substantially 3.53 mm. The length of the second radiating part 104 is substantially 13.9 mm, a width thereof is substantially 4.03 mm. A length of the gap 106 is substantially 12.9 mm, a width thereof is substantially 0.97 mm. A length of each protruding part 108 is substantially 1 mm, a width thereof is substantially 0.2 mm. A length of L is substantially 10 mm.

Figure 3:
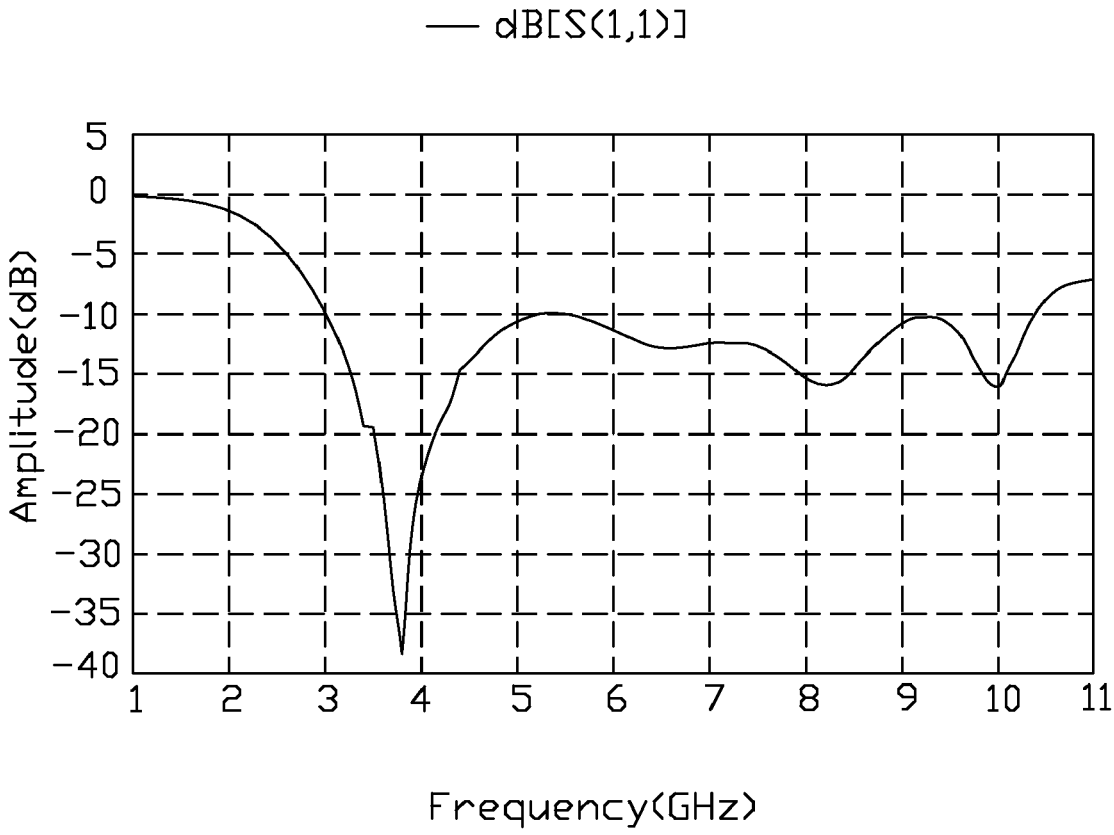
FIG. 3 is a graph of simulated results showing a return loss of the UWB antenna of FIG. 1.

FIG. 3 is a graph of simulated results showing a return loss of the UWB antenna 10 of FIG. 1. As shown in FIG. 3, return losses are less than −8 dB when the UWB antenna 10 is operated at a frequency range from 3.1 GHz to 10.6 GHz.

Figure 4:
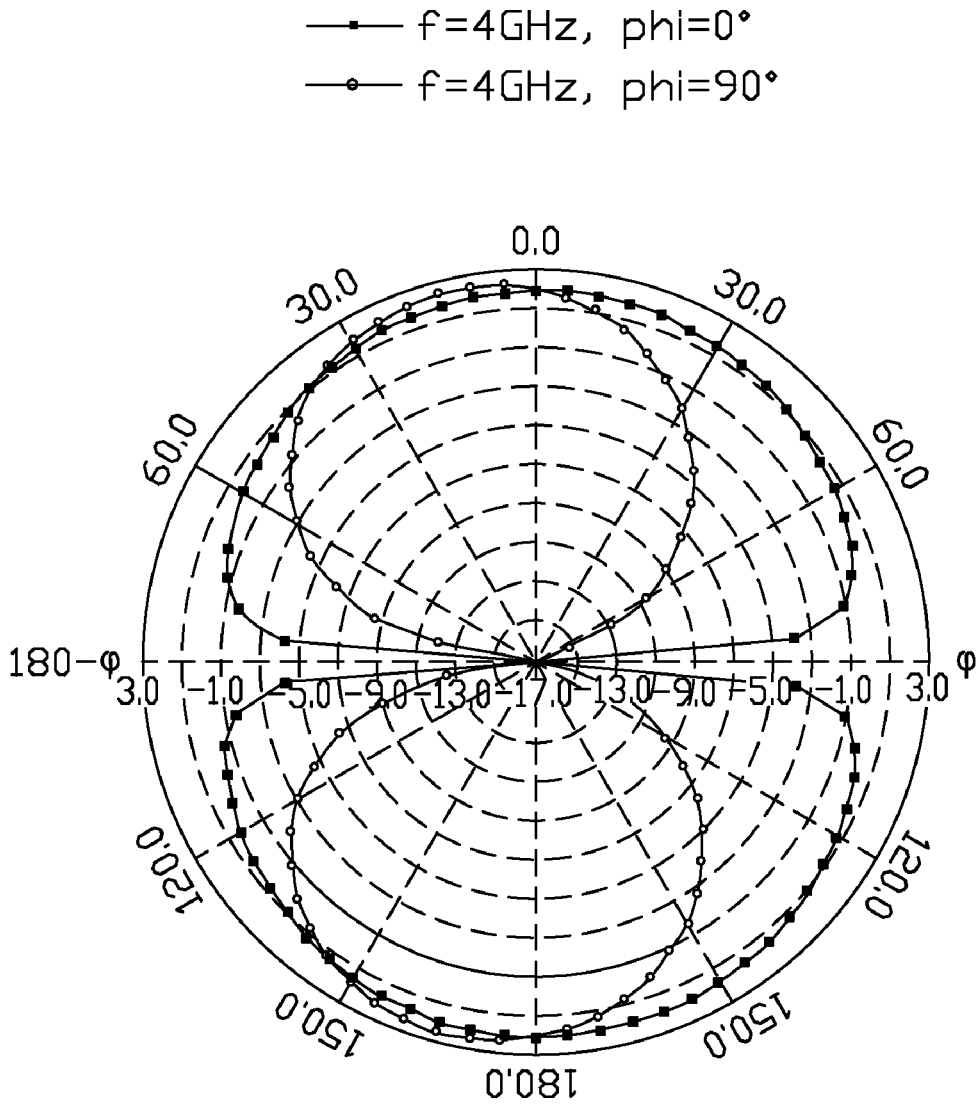
FIG. 4 is a graph of simulated results showing radiation patterns at phi angles of 0 and 90 degrees when the UWB antenna of FIG. 1 is operated at 4 GHz.
Figure 5:
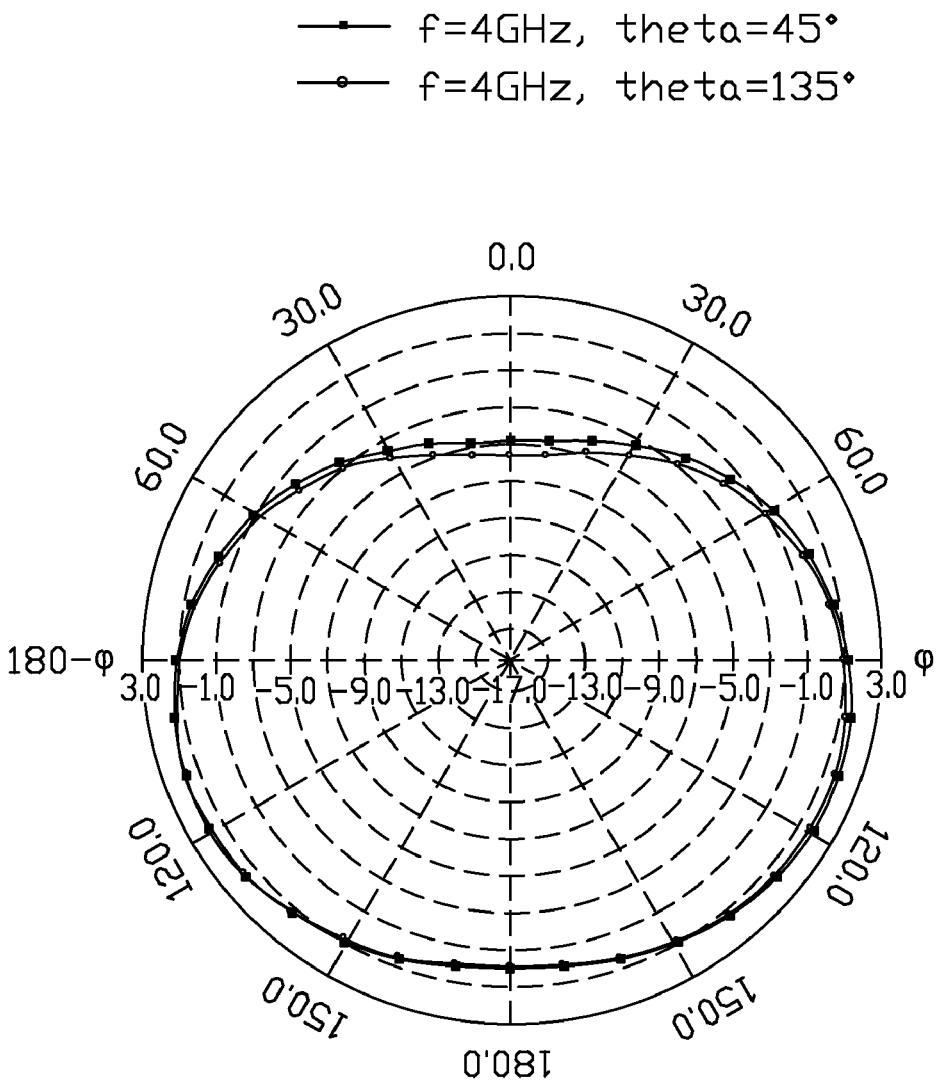
FIG. 5 is a graph of simulated results showing radiation patterns at theta angles of 45 and 135 degrees when the UWB antenna of FIG. 1 is operated at 4 GHz.
Figure 6:
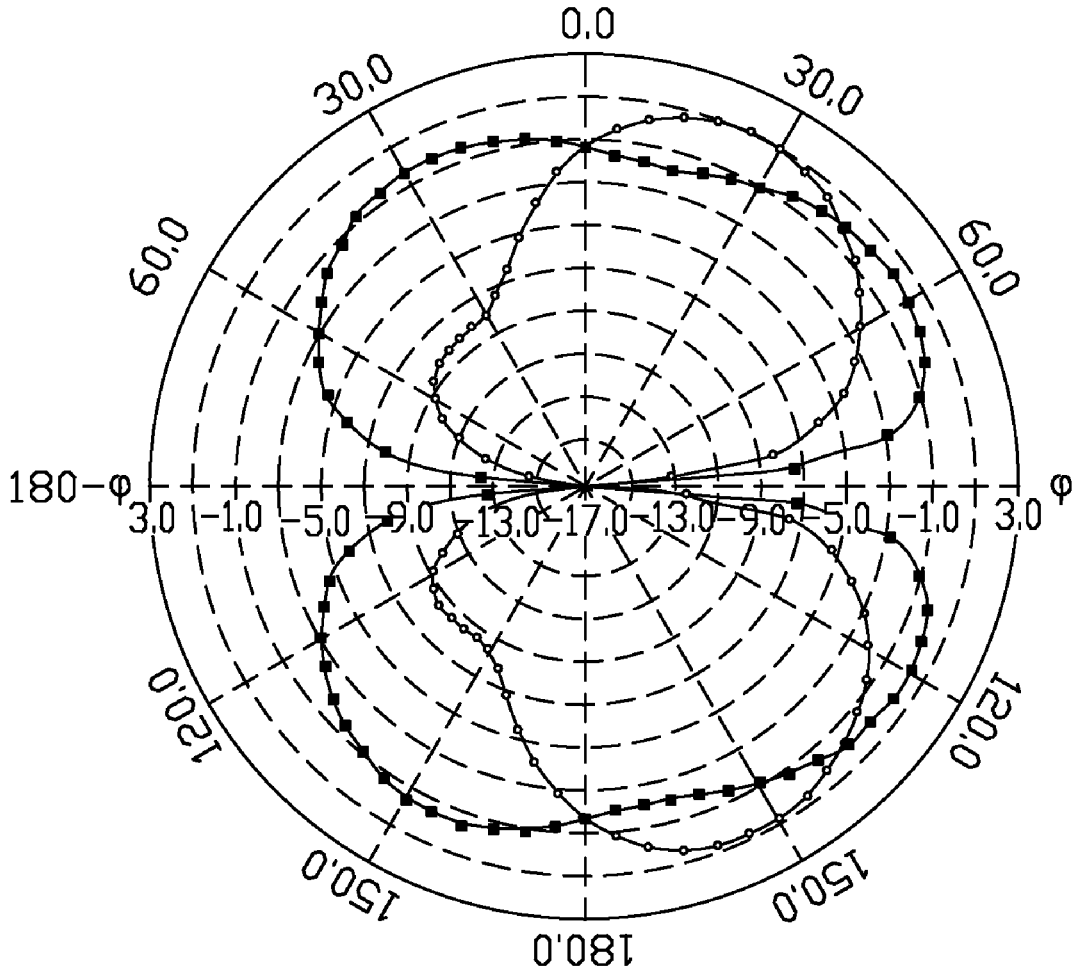
FIG. 6 is a graph of simulated results showing radiation patterns at phi angles of 0 and 90 degrees when the UWB antenna of FIG. 1 is operated at 8 GHz.
Figure 7:
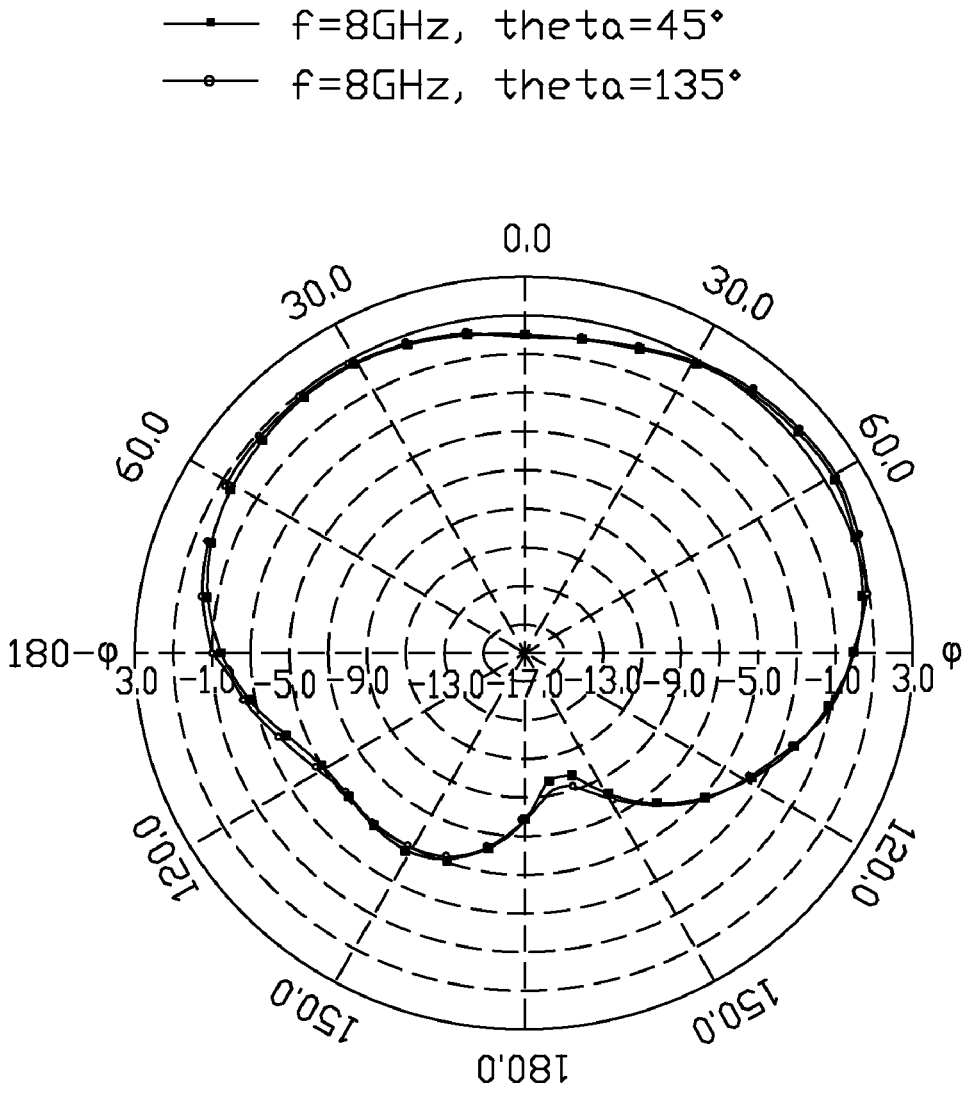
FIG. 7 is a graph of simulated results showing radiation patterns at theta angles of 45 and 135 degrees when the UWB antenna of FIG. 1 is operated at 8 GHz.

FIGS. 4-7 are graphs of simulated results showing radiation patterns at phi angles of 0 and 90 degrees and at theta angles of 45 and 135 degrees when the UWB antenna 10 of FIG. 1 is operated at 4 GHz and 8 GHz, respectively. As shown in FIGS. 4 and 5, the UWB antenna 10 has omnidirectional radiation patterns when operated at 4 GHz. As shown in FIGS. 6 and 7, the UWB antenna 10 has good radiation characteristics when operated at 8 GHz. Thus, the antennas of the invention can be operated between 3.1 and 10.6 GHz while having a reduced size.

Figure 8:
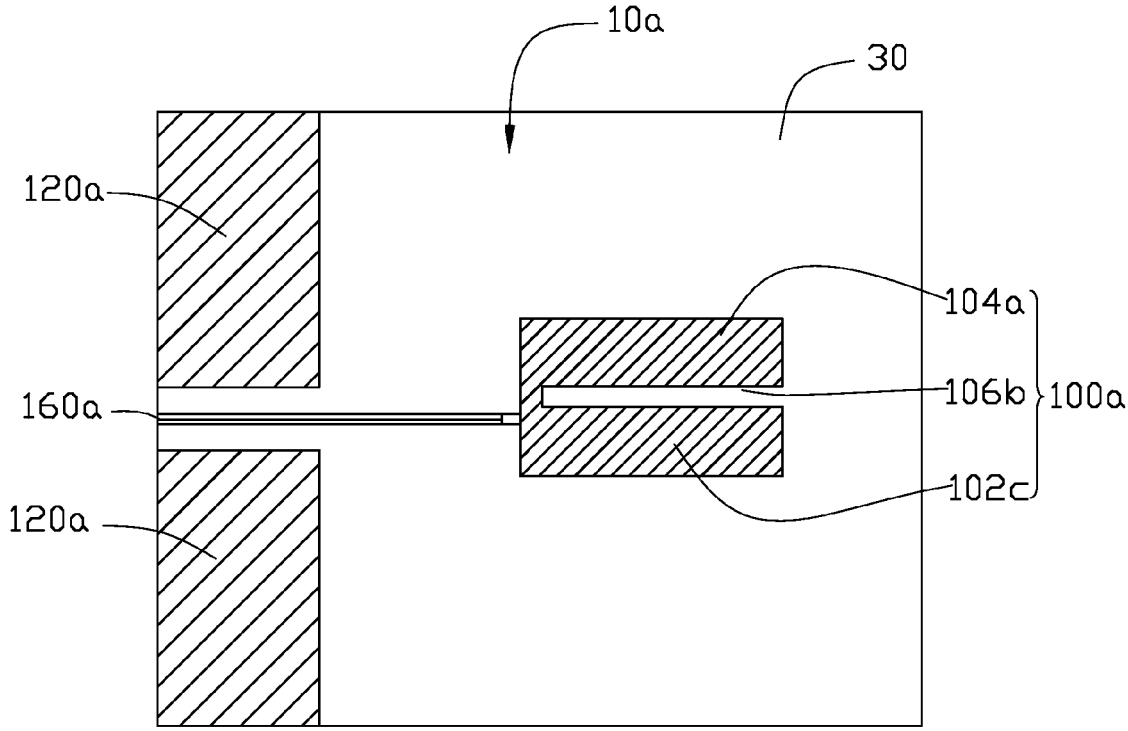
FIG. 8 is a schematic diagram of a UWB antenna of another exemplary embodiment of the present invention.

FIG. 8 is a schematic diagram of a UWB antenna 10*a* of another exemplary embodiment of the present invention. The difference between the UWB antenna 10*a* and the UWB antenna 10 is that neither of a first radiating part 102*a* and a second radiating part 104*a* have the protruding parts 108. That is, a body 100*a* does not have the protruding parts 108. A gap 106*a*, a feeding part 160*a*, and at least one first ground plane 120*a* of the UWB antenna 10*a* are the same as the gap 106, the feeding part 160, and the at least one first ground plane 120 of the UWB antenna 10, respectively, so descriptions are omitted.

In the exemplary embodiment, a length of the first radiating part 102*a* is substantially 14.2 mm, a width thereof is substantially 3.53 mm. A length of the second radiating part 104*a* is substantially 14.2 mm, and a width thereof is substantially 4.03 mm. Dimensions of the other components of the UWB antenna 10*a* are the same as those of the UWB antenna 10.

Figure 9:
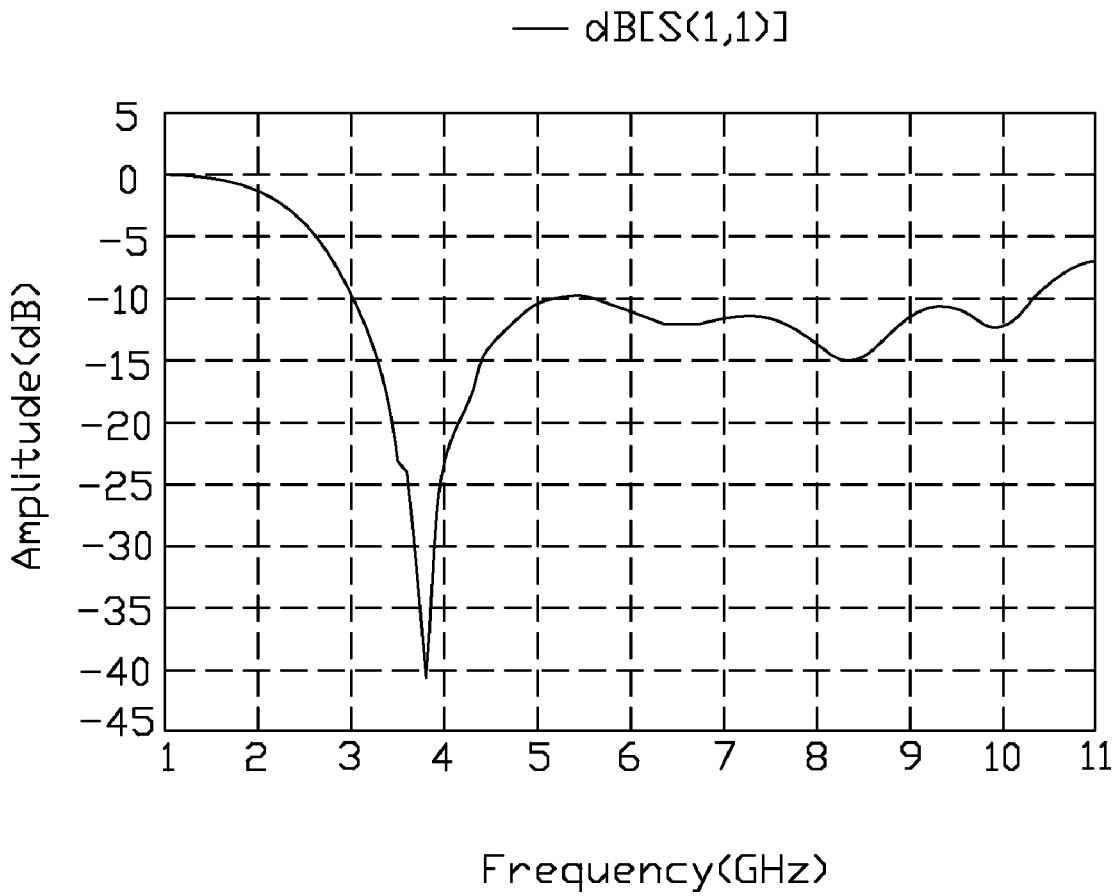
FIG. 9 is a graph of simulated results showing a return loss of the UWB antenna of FIG. 8.
Figure 10:
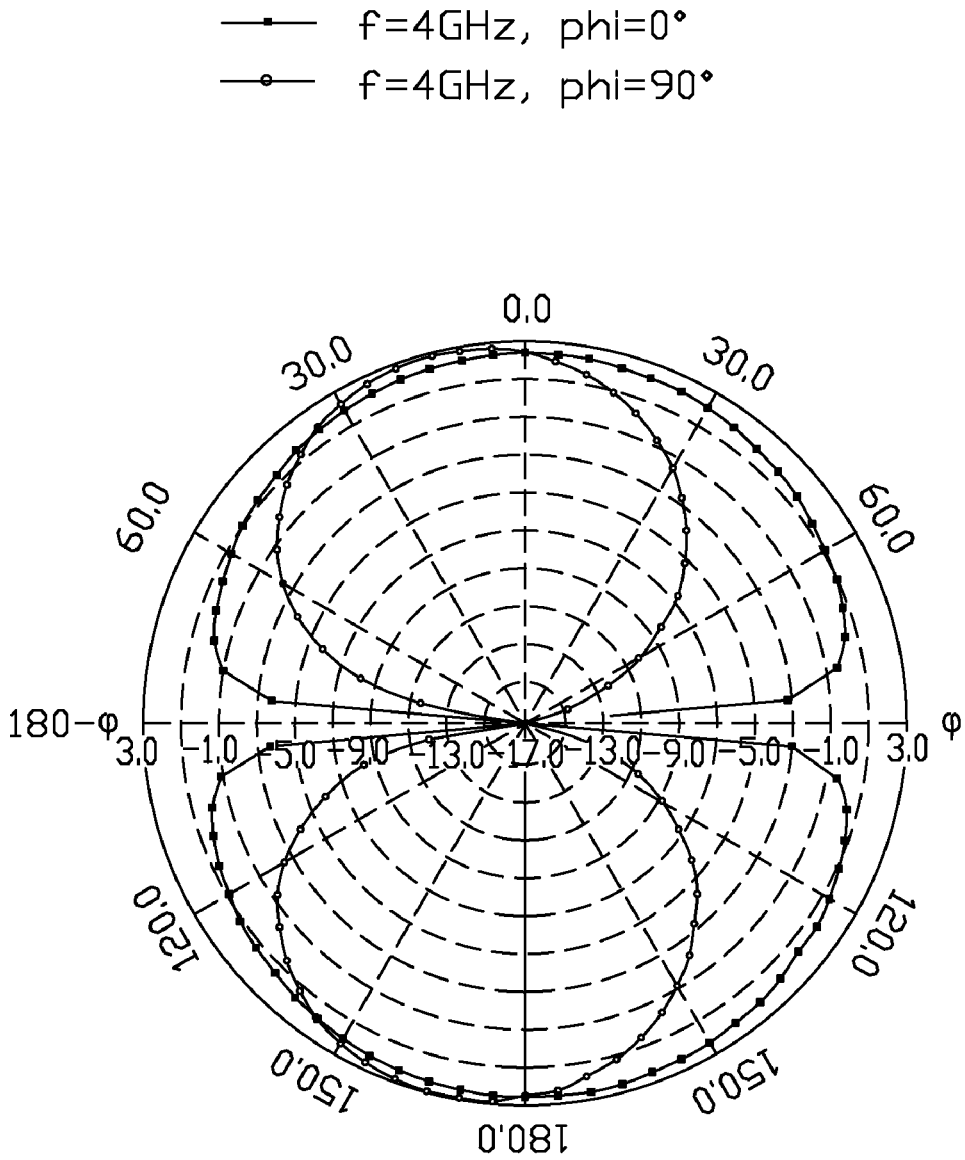
FIG. 10 is a graph of simulated results showing radiation patterns at phi angles of 0 and 90 degrees when the UWB antenna of FIG. 8 is operated at 4 GHz.
Figure 11:
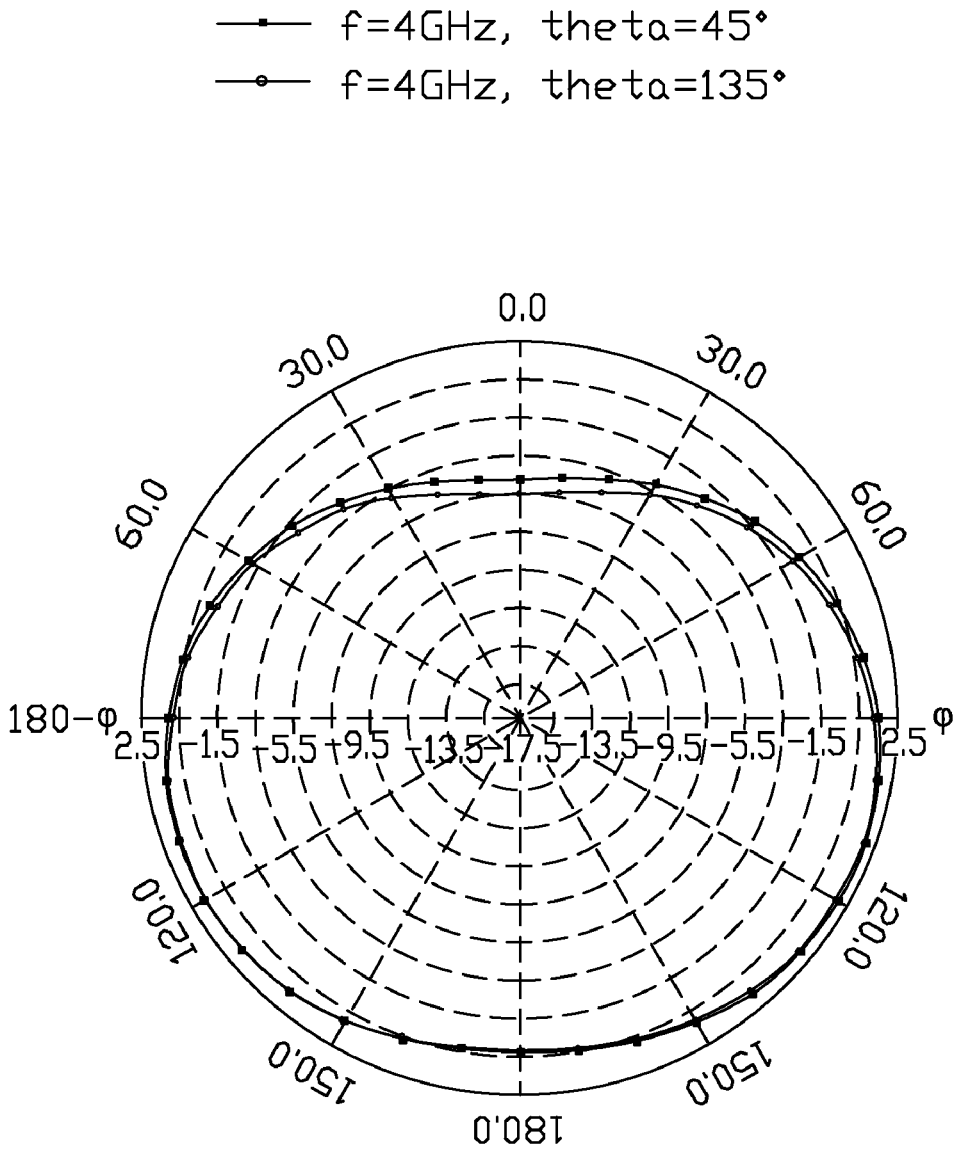
FIG. 11 is a graph of simulated results showing radiation patterns at theta angles of 45 and 135 degrees when the UWB antenna of FIG. 8 is operated at 4 GHz.
Figure 12:
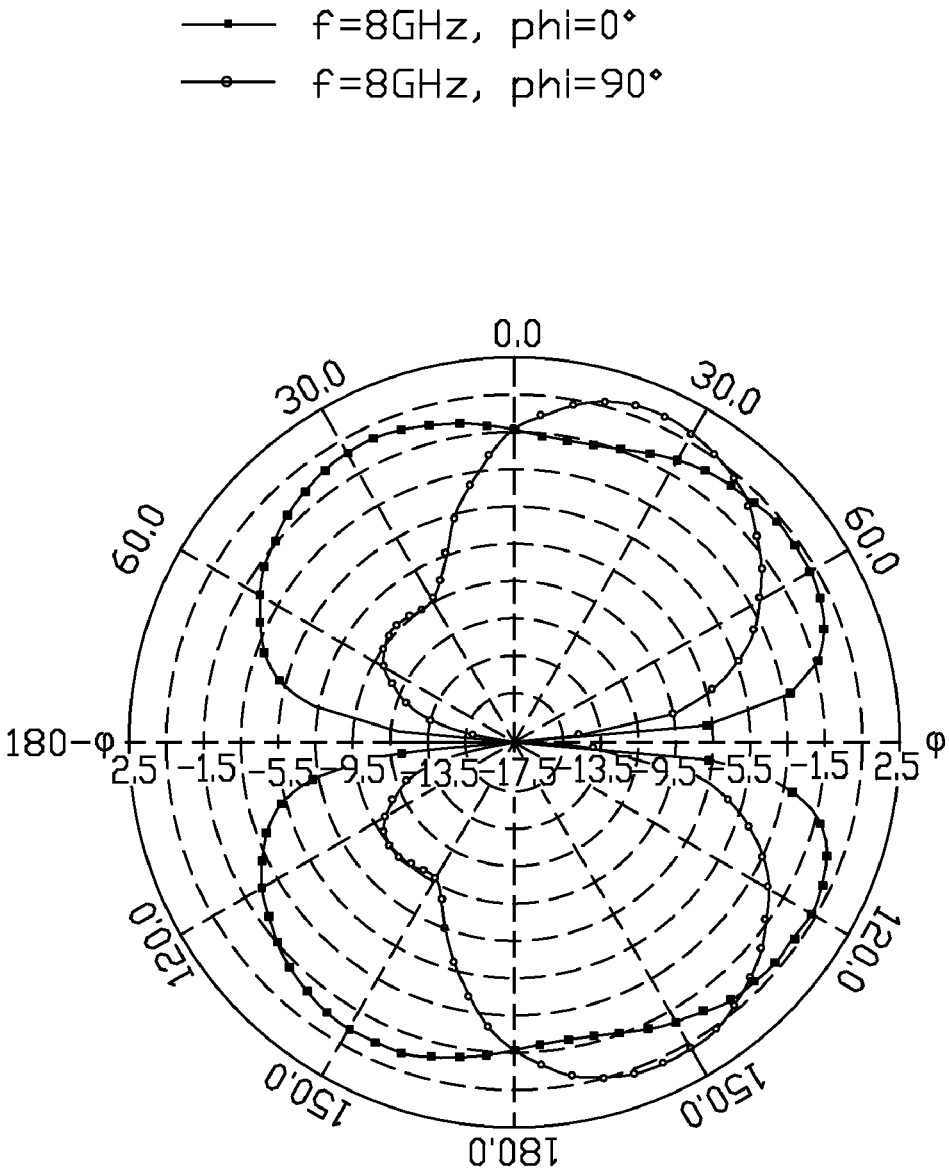
FIG. 12 is a graph of simulated results showing radiation patterns at phi angles of 0 and 90 degrees when the UWB antenna of FIG. 8 is operated at 8 GHz.
Figure 13:
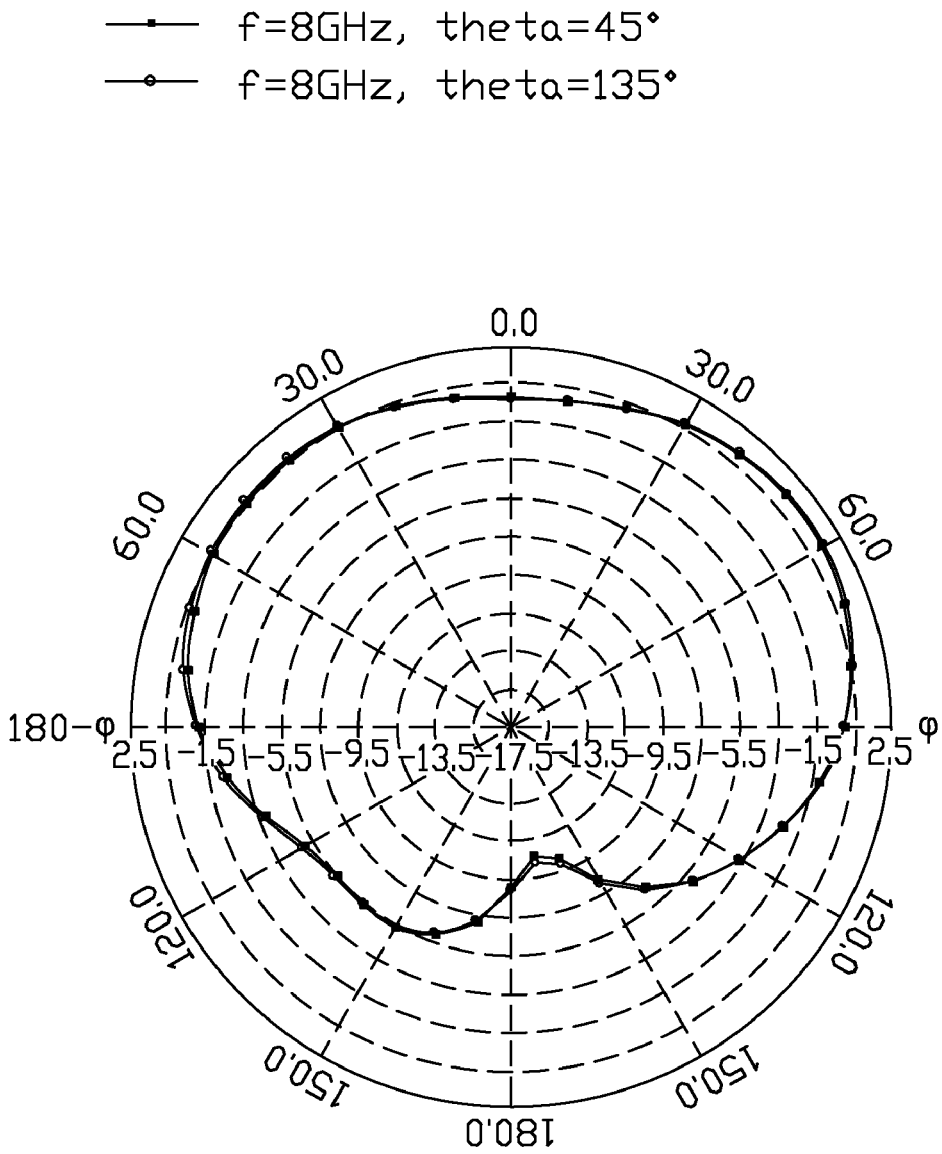
FIG. 13 is a graph of simulated results showing radiation patterns at theta angles of 45 and 135 degrees when the UWB antenna of FIG. 8 is operated at 8 GHz.

FIG. 9 is a graph of simulated results showing a return loss of the UWB antenna 10*a* of FIG. 8. As can be seen, return losses are less than −8 dB when the UWB antenna 10*a* is operated at a frequency range from 3.1 GHz to 10.6 GHz FIGS. 10-13 are graphs of simulated results showing radiation patterns at phi angles of 0 and 90 degrees and at theta angles of 45 and 135 degrees when the UWB antenna 10*a* of FIG. 1 is operated at 4 GHz and 8 GHz, respectively. As shown in FIGS. 10 and 11, the UWB antenna 10*a* has omnidirectional radiation patterns when operated at 4 GHz. As shown in FIGS. 12 and 13, the UWB antenna 10*a* has good radiation characteristics when operated at 8 GHz.

Due to coupling effects generated by the first radiating part 102*a* and the second radiating part 104*a* via the gap 106, the size of the UWB antenna 10*a* is reduced. The working frequency bandwidth of the UWB antenna 10*a* is increased because the length of the second ground plane 140 laid on the second surface of the substrate 30 is greater than that of the at least one first ground plane 120 laid on the first surface of the substrate 30.

Similarly, due to coupling effects generated by the first radiating part 102 and the second radiating part 104 via the gap 106, the size of the UWB antenna 10 is reduced. The working frequency bandwidth of the UWB antenna 10 is increased because the length of the second ground plane 140 laid on the second surface of the substrate 30 is greater than that of the at least one first ground plane 120 laid on the first surface of the substrate 30. In addition, due to the protruding parts 108 the size of the UWB antenna 10 is further reduced, and the working frequency bandwidth of the UWB antenna 10 is further increased.

While various embodiments and methods of the present invention have been described above, it should be understood that they have been presented by way of example only and not by way of limitation. Thus the breadth and scope of the present invention should not be limited by the above-described exemplary embodiments, but should be defined only in accordance with the following claims and their equivalents.

What is claimed is:

1. An ultra-wideband (UWB) antenna, disposed on a substrate, comprising:

a body, for receiving and transmitting electromagnetic signals, comprising:

a first radiating part;

a second radiating part, connected to the first radiating part, and the body defining a gap between the first radiating part and the second radiating part; and a protruding part protruding into the gap;

a feeding part, electrically connected to the body, for feeding electromagnetic signals to the body; and at least one first ground plane, disposed on a side of the feeding part, and being grounded.

2. The UWB antenna as claimed in claim 1, wherein an extending direction of the gap is parallel to that of the feeding part.

3. The UWB antenna as claimed in claim 1, wherein the at least one first ground plane comprises two first ground planes, respectively disposed on both sides of the feeding part.

4. The UWB antenna as claimed in claim 1, wherein the protruding part extends from the first radiating part into the gap.

5. The UWB antenna as claimed in claim 1, wherein the protruding part extends from the second radiating part into the gap.

6. The UWB antenna as claimed in claim 1, wherein the substrate comprises a first surface, and the at least one first round plane is laid on the first surface.

7. The UWB antenna as claimed in claim 6, wherein the substrate further comprises a second surface, and the UWB antenna further comprises a second ground plane laid on the second surface.

8. The UWB antenna as claimed in claim 7, wherein a length of the second ground plane laid on the second surface is greater than that of the at least one first ground plane laid on the first surface.

9. An ultra-wideband (UWB) antenna disposed on a substrate, comprising:

a body for receiving and transmitting electromagnetic signals, the body defining a gap;

a protruding part protruding into the gap;

a feeding part electrically connected to the body for feeding the electromagnetic signals to the body;

a first radiating part of the body extending away from the feeding part and along a first side of the gap to neighbor the gap; and a second radiating part of the body extending away from the feeding part and along a second side of the gap opposite to the first side of the gap to neighbor the gap.

10. The UWB antenna as claimed in claim 9, wherein an extending direction of the gap is parallel to that of the feeding part.

11. The UWB antenna as claimed in claim 9, wherein the protruding part extends from the first radiating part into the gap.

12. The UWB antenna as claimed in claim 9, wherein the protruding part extends from the second radiating part into the gap.

13. The UWB antenna as claimed in claim 9, wherein the protruding part protruding from the first radiating part into the gap is aligned with another protruding part protruding from the second radiating part into the gap.

14. The UWB antenna as claimed in claim 9, wherein the body and the feeding part is disposed on a same first surface of the substrate.

15. The UWB antenna as claimed in claim 14. wherein at least one first ground plane is disposed beside the feeding part on the first surface of the substrate same as the feeding part.

16. The UWB antenna as claimed in claim 15, wherein a second ground plane is disposed beside the feeding part on a second surface of the substrate opposite to the first surface.

17. An antenna assembly comprising:

a substrate; and an antenna disposed on said substrate, comprising a body for receiving and transmitting electromagnetic signals, and a feeding part electrically connectable with said body for feeding said electromagnetic signals and extending away from said body along a first extension direction, said body comprising a first radiating part and a second radiating part neighboring said first radiating part, and a gap defined between said first and second radiating parts to extend along a second extension direction, said second extension direction defined to be parallel to said first extension direction, one of said first and second radiating parts comprising at least one protruding part protruding into said gap toward the other of said first and second radiating parts.

* * * * *